United States Patent [19]

Denlinger et al.

[11] Patent Number: 4,850,888

[45] Date of Patent: Jul. 25, 1989

[54] ELECTRICAL CONNECTOR WITH A DEFLECTABLE SHUNT

[75] Inventors: Keith R. Denlinger, Lancaster; Scott Glatfelter, York; Alexander Hunt, III, Harrisburg, all of Pa.

[73] Assignee: AMP Incorporated, Harrisburg, Pa.

[21] Appl. No.: 179,277

[22] Filed: Apr. 22, 1988

[51] Int. Cl.[4] ..... H01R 29/00

[52] U.S. Cl. ..... 439/188; 439/594

[58] Field of Search ..... 439/188, 511–513, 439/592–594

[56] References Cited

U.S. PATENT DOCUMENTS

| | | | |
|---|---|---|---|
| 3,275,765 | 9/1966 | Ferdon et al. | 200/51.1 |
| 3,627,929 | 12/1971 | Gilissen | 200/51.1 |
| 3,667,101 | 6/1972 | Kloth | 339/28 |
| 3,869,191 | 3/1975 | Tolnar, Jr. et al. | 339/111 R |
| 4,070,557 | 1/1978 | Ostapovitch | 339/19 |
| 4,224,486 | 9/1980 | Zimmerman, Jr. et al. | 339/184 M |
| 4,274,691 | 6/1981 | Abernethy et al. | 339/19 |
| 4,346,959 | 8/1982 | Daugherty et al. | 339/217 S |
| 4,460,234 | 7/1984 | Bogese | 339/128 |
| 4,482,198 | 11/1984 | Crowley | 339/19 |
| 4,501,459 | 2/1985 | Chandler et al. | 339/48 |
| 4,552,423 | 11/1985 | Swengel, Jr. | 339/19 |
| 4,557,542 | 12/1985 | Coller et al. | 339/59 M |
| 4,582,376 | 4/1986 | Olsson | 339/19 |
| 4,588,242 | 5/1986 | McDowell et al. | 339/59 M |
| 4,633,048 | 12/1986 | Komatou | 439/188 |
| 4,685,887 | 8/1987 | Hanning | 439/188 |
| 4,725,241 | 2/1988 | Bertini et al. | 439/188 |
| 4,726,775 | 2/1988 | Owen | 439/49 |
| 4,737,118 | 4/1988 | Lockard | 439/594 |

FOREIGN PATENT DOCUMENTS

| | | | |
|---|---|---|---|
| 3302716 | 8/1983 | Fed. Rep. of Germany | 439/188 |
| 232674 | 11/1985 | Japan | 439/188 |

OTHER PUBLICATIONS

IBM Technical Disclosure Bulletin, vol. 7, No. 6, Nov. 1964, Switching Connector, N. K. Perkins.

*Primary Examiner*—P. Austin Bradley

*Attorney, Agent, or Firm*—Robert W. Pitts

[57] ABSTRACT

A connector assembly comprises one electrical connector having at least two terminals shunted in the unmated configuration and a second pull to seat connector. The shunt in the first connector comprises a longitudinally extending beam having laterally extending contact arms which engage adjacent terminals in the unmated configuration. A cap, which can be secured to the mating face of the second connector after terminals are withdrawn into the connector through the mating face, contains a ramp surface which engages the longitudinally extending beam of the deflectable shunt when the two connectors are mated. Clearance is provided on the mating face of the pull to seat connector so that the deflectable shunt is maintained out of engagement with the pins and receptacle terminals in the first and second connectors.

16 Claims, 4 Drawing Sheets

14d
10d
10c
6
10a
18f
14c
2
18b
14
10
10b
14e
14f
18c
18a
12a
12d
8
4
16b
16c
16a
12
16

ELECTRICAL CONNECTOR WITH A DEFLECTABLE SHUNT

BACKGROUND OF THE INVENTION

1. Field of the Invention

This invention relates to an electrical connector assembly formed of two mating connectors, one connector having a deflectable shunt for commoning at least two terminals when unmated, the other connector deflecting the shunt during engagement. More particularly, this invention relates to a pull to seat connector assembly in which terminals are loaded in one housing from the mating side and the deflectable shunt is in the other connector.

2. Description of the Prior Art

U.S. patent application Ser. No. 049,633 filed May 13, 1987 discloses an electrical connector assembly in which the receptacle connector contains at least one spring loaded deflectable shunt. That spring loaded deflectable shunt engages receptacle terminals in the one connector when that connector is disengaged from a mating connector. Upon engagement with a mating connector containing a plurality of pins, the deflectable shunt engages a camming member located adjacent the pins to deflect the shunt out of contact with all of the terminals in the first connector. A connector of that type is especially useful in certain automotive applications. For instance, the connector can be used as part of an airbag safety system. The shunted configuration can be employed to detect an unmated or partially mated configuration and can be employed to prevent inadvertent actuation of the airbag system during servicing.

The airbag connector previously referred to is in other respects a standard connector in which the receptacle terminal contacts are crimped to individual wires and then inserted into the connector housing from the rear. So-called pull to seat connectors have been proposed as an alternative to such crimp-snap configurations. A pull to seat connector is a connector in which an unterminated wire is first inserted through an insulating housing from the rear so that the free end of the wire projects beyond the mating face of the housing. The terminals are then crimped to the wires and the wires are pulled to withdraw the terminals into the connector housing. So-called pull to seat connectors provide more secure engagement of the terminal with the housing and simplify the construction of the insulative housing.

SUMMARY OF THE INVENTION

The instant invention is directed to an electrical connector assembly having a deflectable shunt in one of two matable connectors. The other matable connector can comprise a pull to seat connector, the so-called pull to seat connector having a cap which can be secured to the mating face of the connector. The cap has ramp surface oriented to engage the deflectable shunt when the two connectors are mated. In the preferred embodiment of this invention, the deflectable shunt comprises a cantilever beam having laterally extending arms which engage separate connectors. The cap has a ramp surface which engages the central beam of the deflectable shunt. Suitable clearance is provided for the laterally extending arms.

DETAILED DESCRIPTION OF THE PREFERRED EMBODIMENT

Figure 1:
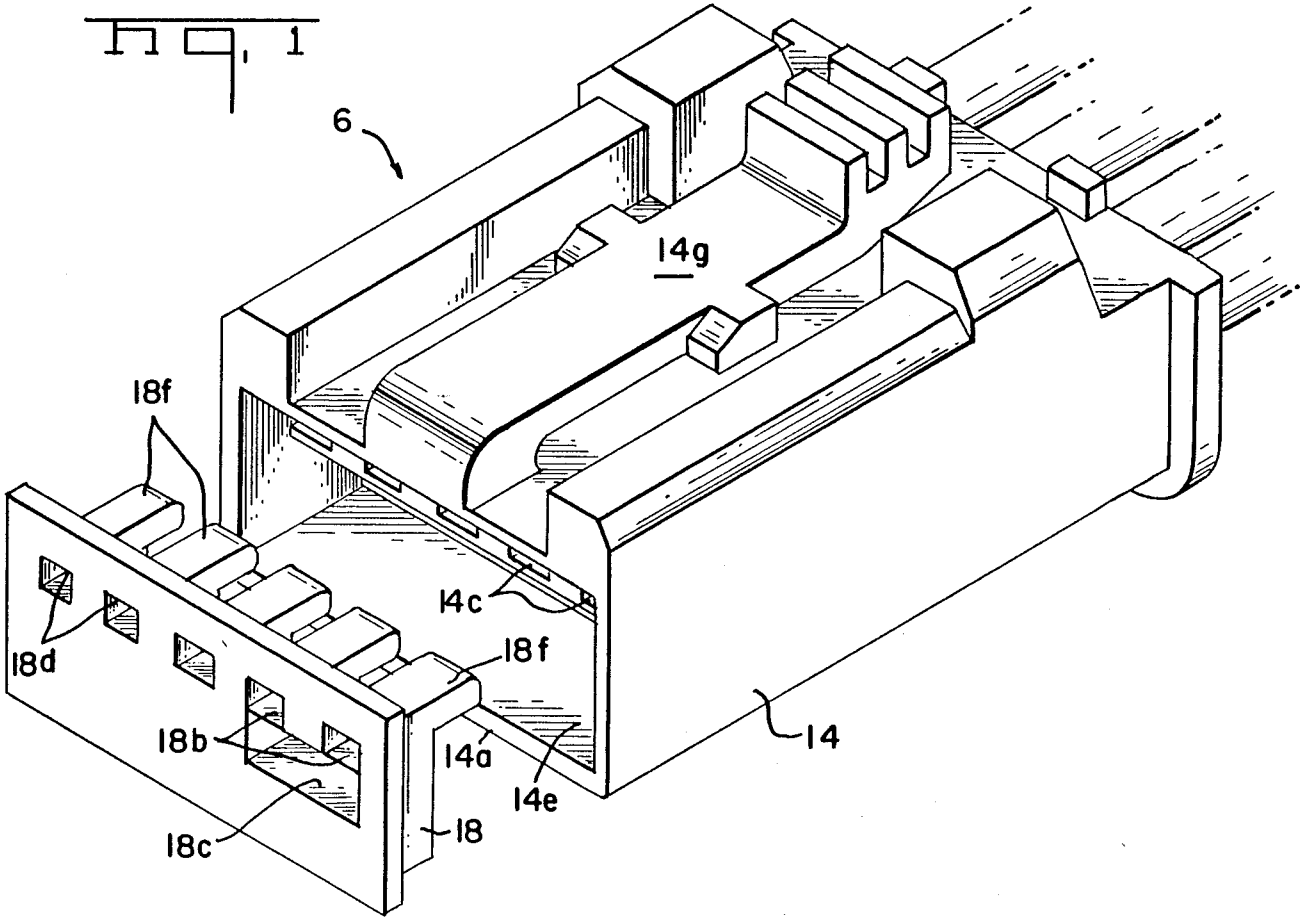
FIG. 1 is a perspective view of a pull to seat connector showing a cap member exploded from the mating face of the connector.
Figure 2:
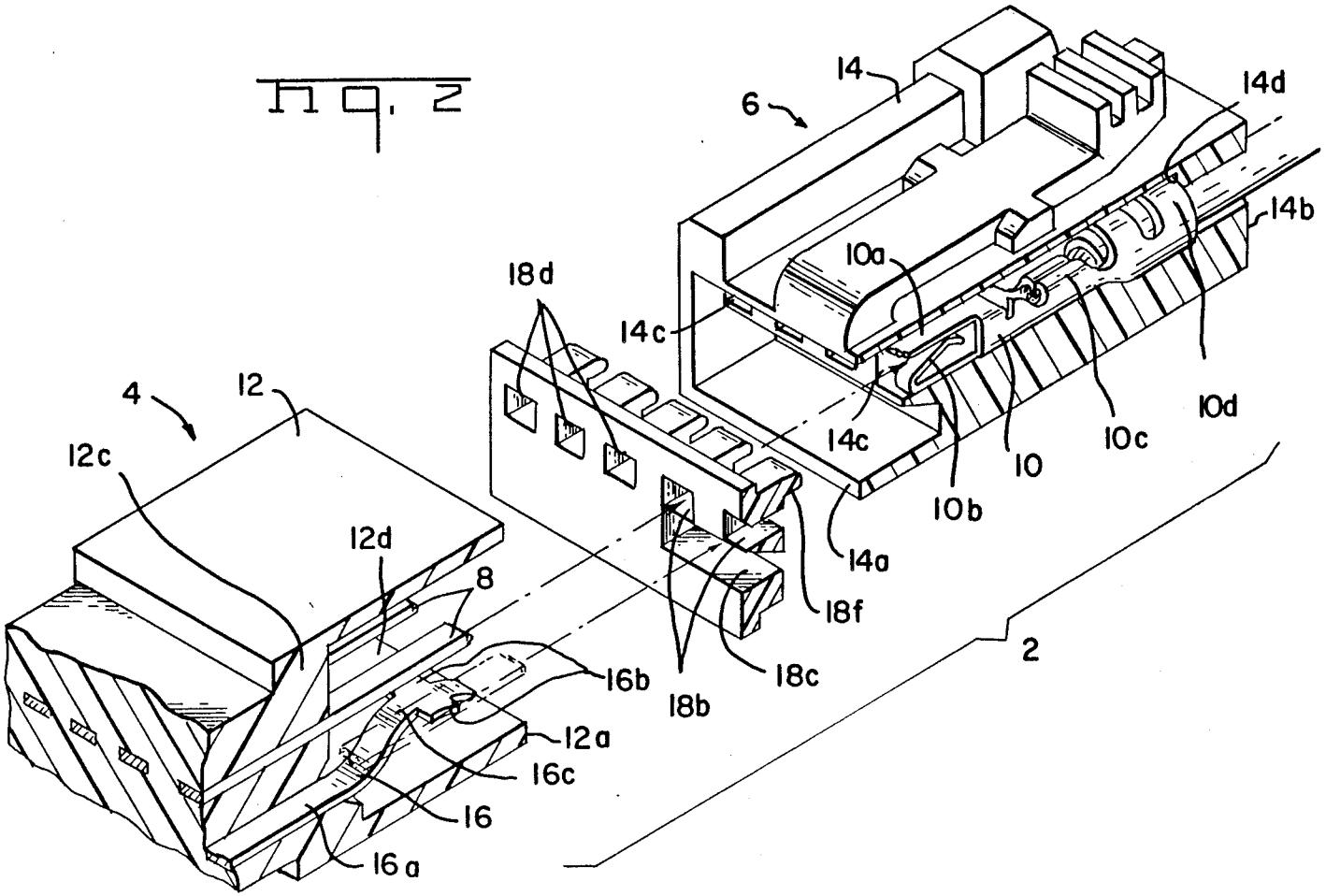
FIG. 2 is an exploded view, partially in section, of the connector assembly showing the deflectable shunt in one of the connectors.
Figure 3:
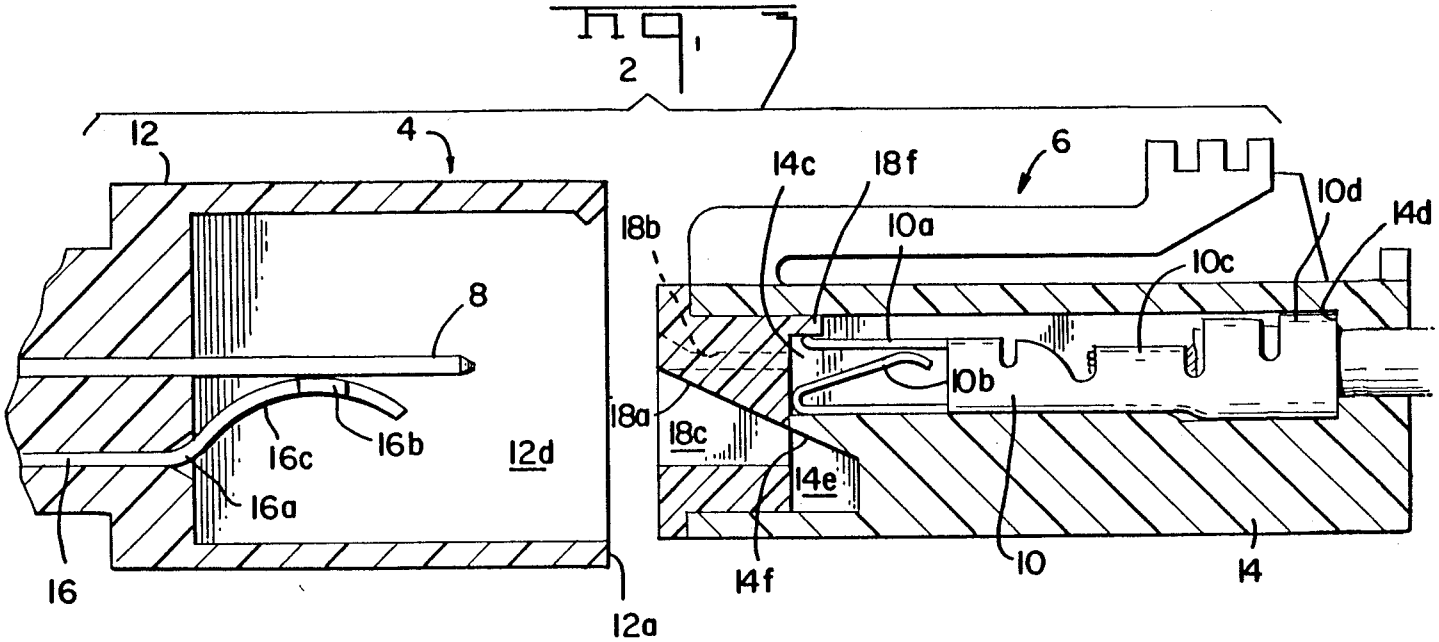
FIG. 3 is a sectional view of the connectors in alignment prior to mating.

The electrical connector assembly 2 comprises a first mating electrical connector 4 and a second mating electrical connector 6. The first electrical connector 4 includes a plurality of contact terminals 8 in the form of a plurality of pins located in at least one row. The second electrical connector 6 includes a like plurality of receptacle terminals 10 each crimped to a single conductor such as an insulated wire. Terminals 8 in the first connector 4 are located within an insulative housing 12, and terminals 10 of the second connector 6 are similarly located in an insulative housing 14 matable with the insulative housing 12 so that the two connectors 4 and 6 can be mated by bringing the mating faces of the connectors into engagement. The connector assembly further comprises a spring biased shunt 16 in the first connector 4. Shunt 16 engages at least two of the terminals 8. An insulative cap 18, which is securable to the mating face of the second connector 6, is also a part of the connector assembly. The terminals 8, 10 and the shunt 16 are stamped and formed from a conventional spring metal material. Housings 12, 14 and the cap 18 are likewise formed of conventional insulative materials suitable for use in electrical connector assemblies.

While the terminals 8 in the first connector 4 can comprise a simple blade or pin contact, such as a contact which can be soldered to a printed circuit board, the terminals 10 in the second connector 6 comprise stamped and formed receptacle contacts. Terminals 10 have a front or mating receptacle contact portion **10*a* which includes a folded over spring section 10*b* located within the generally box-shaped configuration of contact portion 10*a*. A standard wire crimp 10*c* is located intermediate the ends of terminal 10 for engagement with the conductive core of a single wire. An insulation crimp or strain relief section 10*d* is located adjacent the rear end of each terminal 10**.

Insulative housing 12 includes a mating face **12*a* and an opposite rear face 12*b* which, in the preferred embodiment of this invention, can be mountable on a printed circuit board. The individual pin terminals 8 protrude from a mating wall 12*c* intermediate the ends of the housing 12 into a cavity 12*d* which opens onto the mating face 12*a*. The shunt 16 similarly protrudes from the mating wall 12*c* into cavity 12*d* where engagement can be established with at least two pin terminals 8. The cavity 12*d*, which opens onto the mating face 12*a* of the first connector 4, is dimensioned to permit insertion of the first connector 6 when the two connectors 4 and 6** are mated.

The second or receptacle connector 6 has an insulative housing 14 with a mating face **14*a* and an opposite rear or wire receiving face 14*b*. A plurality of terminal passages 14c extend between the mating face 14a and the rear or wire receiving face 14b. A restricted portion of each terminal passage 14c is located adjacent the rear face 14b to form a terminal stop 14d. The restricted portion adjacent the rear face 14b is smaller than the diameter or width of an individual terminal 10 so that the terminals can only be inserted into the connector housing 14 through the mating face 14a. The presence of this stop 14d will then permit withdrawal of the crimped terminal 10 through the rear face of the housing. The second connector 6 thus comprises a pull to seat connector in which a conductor must first be inserted into passages 14c through the rear face 14b until the free end of the terminal extends beyond the mating face 14a. A terminal 10 is then crimped onto the free end of each wire with the crimp portion 10c engaging the conductive core of each wire and with the insulation barrel or strain relief 10d engaging the insulation. The wire is then pulled back to draw each terminal 10 into a corresponding terminal passage 14c until the rear insulation barrel portion 10d abuts the shoulder 14d to prevent further rearward movement of each terminal 10. The contact portion 10a then faces the mating face 14a and the spring contact 10b is accessible through the mating face 14a of the housing 14. An elongate shunt recess 14e is located along the mating face 14a below the terminal receiving passages 14c. A downwardly sloping surface 14f is located along the top of the shunt recess 14e and below the lower wall of each passage 14c. The contour of the mating face 14a of the second housing 14 is such that the mating face 14a can be at least partially received within the cavity 12d in the first connector housing 12**.

The spring biased shunt 16 comprises a longitudinally extending central beam 16a with a plurality of arms or wings 16b extending laterally therefrom. In the preferred embodiment of this invention, the spring biased shunt extends from the mating wall 12c of the first connector housing 12 into cavity 12d. At the point where the longitudinal extending beam 16a extends from the mating wall 12c, the shunt is spaced below the pins 8 which are to be commoned by the shunt 16. A portion of the shunt located within cavity 12d is generally arcuate, forming a crown at its uppermost extent. The laterally extending arms or wings 16b are located at the uppermost extent of crown 16c of the longitudinally extending beam 16a. In the preferred embodiment of this invention, the longitudinally extending beam 16a is located laterally between adjacent pins 8. The laterally extending arms 16b thus extend from the crown section 16c so as to overlap adjacent pins 8. Since the shunt 16 is normally biased upward, the wings 16b thus engage the two adjacent pins 8 to be commoned when the first connector 4 is disengaged from the second connector 6.

The cap 18 performs two functions. First, the cap is securable to the mating face 14a of the second housing 14 to retain the terminals 10 within terminal receiving passages 14c so that forward movement of the terminals out of mating face 14a is not permitted. The cap 18 also serves to deflect the shunt 16 out of engagement with pins 8 when the first connector 4 is mated to the second connector 6. The cap 18 is secured to the mating face 14a of the second housing 14. The cap 18 has at least one ramp surface 18a extending between opposite faces of the cap 18 and oriented for engagement with the arcuate portion of the longitudinally extending beam 16a. It is this ramp surface 18a which will initially engage the longitudinally extending beam 16a to move the shunt 16 out of engagement with pins 8. A plurality of openings 18b are located in the cap 18 and are oriented to receive the respective pins 8 and align pins 8 for engagement in the contact portions 10a of receptacle terminals 10. A shunt clearance opening 18c is located below the two terminal receiving openings 18b which are intended to receive the two aligned pins 8. The housing may be extended below the two openings 18b which will receive shunted pins 8 to form a continuation of the ramp surface 18a, thus ensuring that shunted pins 8 will be aligned with corresponding terminals 10. A plurality of retention fingers 18f extend from the rear mating face of the cap 18 and are oriented for insertion into the forward portion of the individual terminal receiving passages 14c. These retention fingers 18f are dimensioned to be tightly received within the terminal receiving passages 14c to secure a tight frictional or interference fit between the retention cap and the housing 14. Thus, the cap will serve to tightly secure the terminals 10, preventing movement of the terminals out of the mating face 14a of housing 14.

Figure 4:
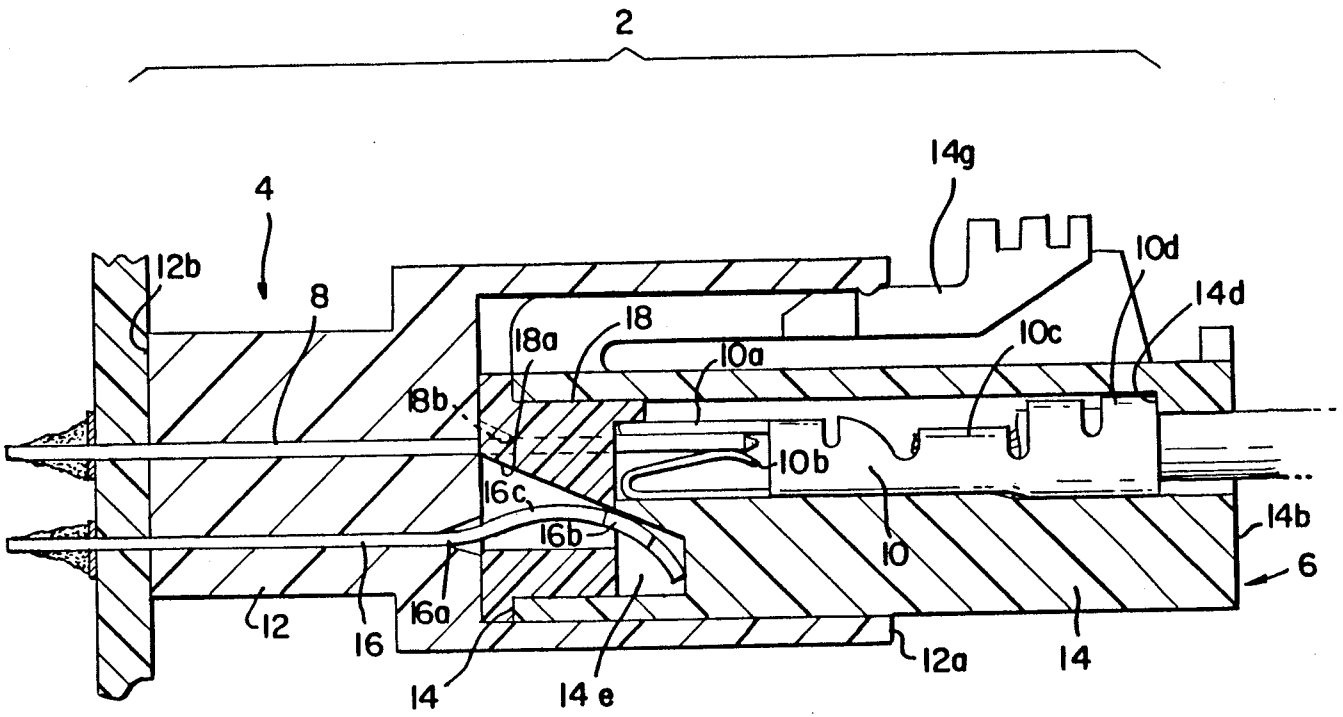
FIG. 4 is a view of the fully mated connector assembly showing the shunt biased out of engagement with the terminals in each connector.

When the first and second connectors 4 and 6 have been fully mated, the shunt 16 is at least partially received within recess 14e after having been deflected out of engagement with pins 8 by the ramp surface 18a. The pins 8 are received within the receptacle contact portion 10a and a resilient contact is established by the deflectable spring 10b. The mating face 14a of housing 14 and the cap 18 are received within the cavity 12d. As shown in FIG. 4, the front face of the cap 18 can be in engagement with the mating wall 12c at the rear of the cavity 12d. The first connector 4 is secured to the second connector 6 by a deflectable latch 14g located on the exterior of housing 14. It will be apparent to one of ordinary skill in the art that the aforementioned elements could be combined into other configurations to perform substantially the same function in substantially the same manner. Therefore, the claims presented herein are not limited to the single preferred embodiment depicted herein which comprises the best mode of practicing the instant invention.

We claim:

1. An electrical connector assembly comprising first and second mating electrical connectors, each connector having a plurality of terminals positioned within an insulative housing, the first connector having a spring biased shunt engagable with two terminals, the second connector including a cap securable to a mating face thereof, the cap having a ramp surface, the spring biased shunt being engagable with the ramp surface of the cap when the first connector is mated with the second connector to move the shunt out of engagement with the terminals in the first connector when the first and second connectors are mated, the terminals in the second connector being insertable into the second connector housing through the mating face thereof.

2. The electrical connector assembly of claim 1 wherein the shunt comprises a longitudinally extending beam positioned between two terminals in the first housing with arms extending laterally of the beam to engage the two terminals, the beam being engagable with the ramp surface to move the two arms out of engagement with the two terminals when the first and second connectors are mated.

3. The electrical connector assembly of claim 1 wherein the second connector comprises a pull to seat connector.

4. The electrical connector of claim 1 wherein the second connector comprises a pull to seat connector, the cap securable to the second connector so that the mating side of the cap is opposed to a free end of each second connector terminal, the cap comprising means to retain the second connector terminals in the second connector insulative housing.

5. The electrical connector assembly of claim 1 wherein the second connector has a plurality of passages extending between the mating face and an opposite rear face, the cap having a plurality of fingers extending from a mating side thereof, each finger being received in a corresponding passage to frictionally engage the second housing to retain the cap on the second housing.

6. The electrical connector assembly of claim 5 wherein the first connector housing has a cavity on the first connector mating face, the cavity being large enough to receive a portion of the second connector adjacent the mating face when the first and second connectors are mated.

7. The electrical connector assembly of claim 6 wherein the cap is entirely received within the cavity when the first and second connectors are mated.

8. The electrical connector assembly of claim 7 wherein the shunt and the terminals in the first connector extend from a mating wall into the cavity.

9. The electrical connector assembly of claim 8 wherein the shunt forms a cantilever extending from the mating wall.

10. An electrical connector assembly comprising first and second mating electrical connectors, each connector having a plurality of terminals positioned within an insulative housing, the first connector having a spring biased shunt engagable with two terminals, the second connector having a camming surface on a mating face and including a cap securable to the mating face thereof, the cap having a recess of sufficient width to permit passage of the shunt through the cap, the cap being aligned with the camming surface, the spring biased shunt being engagable with the camming surface when the first connector is mated with the second connector to move the shunt out of engagement with the terminals in the first connector when the first and second connectors are mated.

11. The electrical connector assembly of claim 10 wherein the free end of each second connector terminal is located adjacent the intersection between the camming surface and the mating face of the second connector.

12. The electrical connector assembly of claim 10 wherein the shunt comprises a longitudinally extending beam positioned between two terminals in the first housing with arms extending laterally of the beam to engage the two terminals, the beam being engagable with the camming surface to move the two arms out of engagement with the two terminals when the first and second connectors are mated, the width of the recess in the cap being at least equal to the lateral extent of the shunt arms.

13. The electrical connector assembly of claim 12 wherein one side of the cap recess forms a ramp surface aligned with the camming surface, the shunt beam engaging the ramp surface before engaging the camming surface.

14. The electrical connector assembly of claim 13 wherein the second connector comprises a pull to seat connector.

15. The electrical connector assembly of claim 14 wherein the cap is securable to the second connector so that a mating side of the cap is opposed to a free end of each second connector terminal, the cap comprising means to retain the second connector terminals in the second insulative housing.

16. An electrical connector assembly comprising first and second mating electrical connectors, each connector having a plurality of terminals positioned within an insulative housing, the first connector having a deflectable cantilever shunt having a longitudinally extending beam and arms extending laterally from the beam, the arms being engagable with two terminals, the longitudinally extending beam of the deflectable cantilever shunt and the two terminals extending from an intermediate wall into a cavity on a mating face of the first connector housing, the second connector including a surface on a mating face, the first and the second connectors being matable with the longitudinally extending beam in alignment with the surface so that the longitudinally extending beam is engagable with the surface when the first connector is mated with the second connector to move the deflectable cantilever shunt out of engagement with the terminals in the first connector when the first and second connectors are mated.

* * * * *